US010807370B2

(12) United States Patent
Kanazawa et al.

(10) Patent No.: US 10,807,370 B2
(45) Date of Patent: Oct. 20, 2020

(54) CAP AND LIQUID EJECTING APPARATUS

(71) Applicant: SEIKO EPSON CORPORATION, Tokyo (JP)

(72) Inventors: Yuji Kanazawa, Shiojiri (JP); Masaaki Ando, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/680,088

(22) Filed: Nov. 11, 2019

(65) Prior Publication Data

US 2020/0147970 A1 May 14, 2020

(30) Foreign Application Priority Data

Nov. 13, 2018 (JP) ..... 2018-212775

(51) Int. Cl.
*B41J 2/165* (2006.01)

(52) U.S. Cl.
CPC ..... *B41J 2/16505* (2013.01)

(58) Field of Classification Search
CPC ..... B41J 2/16505; B41J 2/16508
See application file for complete search history.

(56) References Cited

U.S. PATENT DOCUMENTS 6,179,404 B1 * 1/2001 Kawarama ..... B41J 2/16508 347/31
6,203,136 B1 * 3/2001 Takahashi ..... B41J 2/16508 347/29
2008/0211860 A1 * 9/2008 Yamaguchi ..... B41J 2/16508 347/30
2010/0045733 A1 * 2/2010 Mano ..... B41J 2/17596 347/29
2012/0154484 A1 * 6/2012 Hashimoto ..... B41J 2/16523 347/31
2019/0061353 A1 * 2/2019 Shimizu ..... B41J 2/165

FOREIGN PATENT DOCUMENTS

| | | | | |
|---|---|---|---|---|
| EP | 0901905 | * | 3/1999 | ..... B41J 2/16508 |
| JP | H07-186405 | | 7/1995 | |
| JP | H11-300981 | | 11/1999 | |
| JP | 2002-331673 | | 11/2002 | |
| JP | 2003-089210 | | 3/2003 | |
| JP | 2008-110520 | | 5/2008 | |
| JP | 2011-143567 | | 7/2011 | |

(Continued)

OTHER PUBLICATIONS

Machine translation of JP 2013-193340, published on Sep. 2013 (Year: 2013).*

*Primary Examiner* — Huan H Tran
(74) *Attorney, Agent, or Firm* — Workman Nydegger

(57) ABSTRACT

A cap includes a lip portion, and an inner bottom wall and an atmosphere communication wall that, when an opening with the lip portion as an edge is covered by a member, form a recessed portion that forms a space with the member, the atmosphere communication wall being provided at a position between the opening and the inner bottom wall in a depth direction of the recessed portion, the atmosphere communication wall having a communication port of an atmosphere communication portion that opens the space to the atmosphere, the communication port being formed in the atmosphere communication wall toward the opening.

8 Claims, 8 Drawing Sheets

(56) References Cited

FOREIGN PATENT DOCUMENTS

| | | |
|---|---|---|
| JP | 2011-148257 | 8/2011 |
| JP | 2012-126044 | 7/2012 |
| JP | 2012-158072 | 8/2012 |
| JP | 2013-193340 | 9/2013 |
| JP | 2015-217556 | 12/2015 |
| JP | 2018-086741 | 6/2018 |
| WO | 2017-022396 | 2/2017 |

* cited by examiner

CAP AND LIQUID EJECTING APPARATUS

The present application is based on, and claims priority from JP Application Serial Number 2018-212775, filed Nov. 13, 2018, the disclosure of which is hereby incorporated by reference herein in its entirety.

BACKGROUND

1. Technical Field

The present disclosure relates to a cap and a liquid ejecting apparatus.

2. Related Art

For example, as in JP-A-2013-193340, there is a printer that is an example of a liquid ejecting apparatus that prints by ejecting ink that is an example of a liquid from a nozzle of a recording head that is an example of a liquid ejecting portion. The printer includes a resting cap device, which is an example of a cap that suppresses evaporation of ink in the nozzle.

In the resting cap device, an upper end, which is an example of a lip portion, is open, and the upper end is in contact with the recording head so as to form a space between the resting cap device and the recording head. The space formed by the resting cap device and the recording head is opened to the atmosphere by a communication path, which is an example of an atmosphere communication portion.

When a liquid is ejected from the nozzle, the ejected liquid may be scattered and deposited in the resting cap device. When the liquid enters the communication path from an opening portion, which is an example of a communication port, the space formed by the resting cap device and the recording head is not in communication with the atmosphere. Therefore, it is desired that the resting cap have a configuration in which the periphery of the opening portion can be easily cleaned.

Such a problem may occur not only in a printer including the resting cap device but also in a cap and a liquid ejecting apparatus including the cap.

SUMMARY

According to an aspect of the present disclosure, a cap includes a lip portion, and an inner bottom wall and an atmosphere communication wall that, when an opening with the lip portion as an edge is covered by a member, form a recessed portion that forms a space with the member, the atmosphere communication wall being provided at a position between the opening between the inner bottom wall in a depth direction of the recessed portion so as to be visible from the opening, the atmosphere communication wall having a communication port of an atmosphere communication portion that opens the space to the atmosphere, the communication port being formed in the atmosphere communication wall toward the opening.

According to another aspect of the disclosure, a liquid ejecting apparatus includes a liquid ejecting portion having a nozzle surface provided with a nozzle from which a liquid is ejected, a capping device having a cap, and an opening and closing member configured to take a closed position and an open position, the cap including a lip portion that is configured to come in contact with the nozzle surface, and an inner bottom wall and an atmosphere communication wall that form a recessed portion that forms a space including the nozzle when the nozzle surface covers an opening with the lip portion as an edge in a case where the lip portion is in contact with the nozzle surface, the atmosphere communication wall being provided at a position between the opening and the inner bottom wall in a depth direction of the recessed portion, the atmosphere communication wall having a communication port of an atmosphere communication portion that opens the space to the atmosphere, the communication port being formed in the atmosphere communication wall, and the opening and closing member, when located at the closed position, covering the capping device, and, when located at the open position, enabling access to the atmosphere communication wall.

DESCRIPTION OF EXEMPLARY EMBODIMENTS

Hereinafter, an embodiment of a cap and a liquid ejecting apparatus will be described with reference to the accompanying drawings. The liquid ejecting apparatus according to the present embodiment is an ink jet printer that prints an image such as characters and photographs on a medium such as a recording sheet by ejecting ink, which is an example of a liquid.

Figure 1:
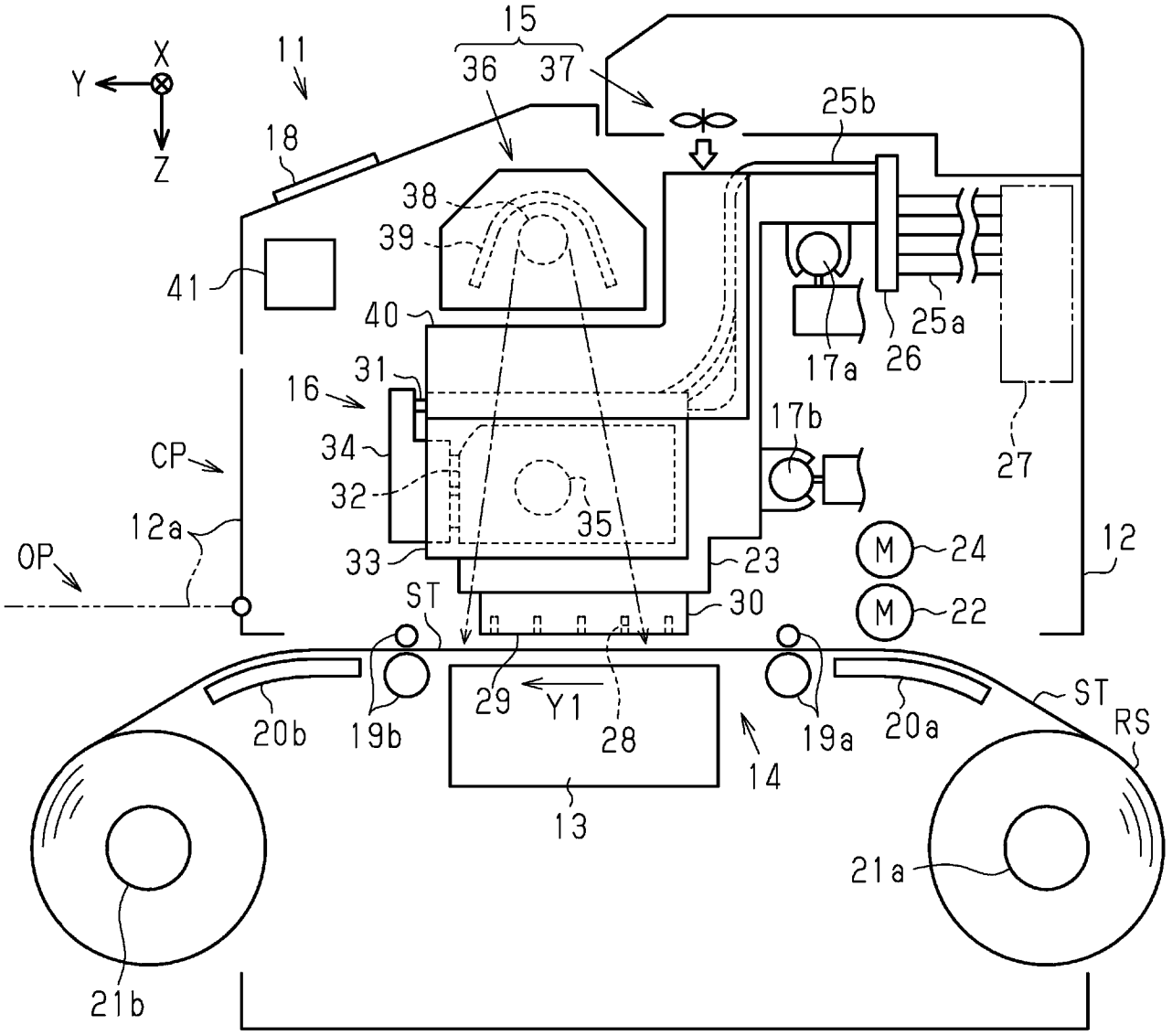
FIG. 1 is a schematic view illustrating an embodiment of a liquid ejecting apparatus.

As illustrated in FIG. 1, a liquid ejecting apparatus 11 includes a casing 12, a support base 13, a transport unit 14, a drying unit 15, a printing unit 16, a first guide shaft 17*a*, and a second guide shaft 17*b*. The liquid ejecting apparatus 11 includes an opening and closing member 12*a* that forms a portion of the casing 12. The opening and closing member 12*a* may be provided so as to be swingable about an axis. The opening and closing member 12*a* is configured to take a closed position CP and an open position OP. The casing 12 houses components such as the support base 13, the drying unit 15, and the printing unit 16. The support base 13, the first guide shaft 17*a*, and the second guide shaft 17*b* extend in the X-axis direction, which is the width direction of the medium ST.

The liquid ejecting apparatus 11 of the present embodiment includes a notification portion 18 configured to display an operating state of the liquid ejecting apparatus 11. The notification portion 18 notifies a user of the operating state of the liquid ejecting apparatus 11 by displaying the operating state of the liquid ejecting apparatus 11. The notification portion 18 of the present embodiment is attached to the casing 12. The notification portion 18 may be configured to enable operation of the liquid ejecting apparatus 11 through a screen that displays an operating state. The notification portion 18 includes, for example, a display screen for displaying information, and buttons for performing operations.

The support base 13 supports a medium ST. The transport unit 14 transports the medium ST, which is sheet-like, from upstream to downstream in the transport direction Y1. The printing unit 16 prints on the medium ST using a liquid. The printing unit 16, at a printing position set on the support base 13, ejects the liquid toward the medium ST to be transported. The Y-axis direction coincides with the transport direction Y1 of the medium ST at the printing position. The drying unit 15 promotes drying of the liquid attached to the medium ST. The X and Y axes intersect the Z axis. The Z-axis direction in the present embodiment is the direction of gravity, which is the ejection direction of the liquid.

The transport unit 14 of the present embodiment includes a first transport roller pair 19*a*, a first guide plate 20*a*, and a supply reel 21*a* disposed upstream of the support base 13 in the transport direction Y1. The transport unit 14 of the present embodiment includes a second transport roller pair 19*b*, a second guide plate 20*b*, and a take-up reel 21*b* disposed downstream of the support base 13 in the transport direction Y1. The transport unit 14 has a transport motor 22 that rotates the first transport roller pair 19*a* and the second transport roller pair 19*b*.

In the present embodiment, the medium ST is fed out from a roll sheet RS wound in a roll shape on the supply reel 21*a*. When the first transport roller pair 19*a* and the second transport roller pair 19*b* rotate in a state of sandwiching the medium ST, the medium ST is transported along the surfaces of the first guide plate 20*a*, the support base 13, and the second guide plate 20*b*. The printed medium ST is taken up by the take-up reel 21*b*. The medium ST is not limited to the medium ST fed from the roll sheet RS, but may be a single sheet medium ST.

The printing unit 16 of the present embodiment has a carriage 23 and a carriage motor 24. The carriage 23 is supported by the first guide shaft 17*a* and the second guide shaft 17*b*. The carriage 23 reciprocates above the support base 13 along the first guide shaft 17*a* and the second guide shaft 17*b* by driving of the carriage motor 24.

The liquid ejecting apparatus 11 has a plurality of first supply tubes 25*a* that can deform so as to follow the carriage 23 that reciprocates, and a connection portion 26 attached to the carriage 23. The upstream end of the first supply tubes 25*a* is connected to a liquid supply source 27. The downstream end of the first supply tubes 25*a* is connected to the connection portion 26. The liquid supply source 27 may be a liquid refillable tank or may be a cartridge removable from the casing 12.

The printing unit 16 includes a liquid ejecting portion 30 having a nozzle surface 29 provided with nozzles 28 from which a liquid is ejected. The liquid ejecting portion 30 is mounted on the carriage 23 such that the nozzle surface 29 faces the support base 13 or the medium ST supported by the support base 13. The printing unit 16 includes, as components held by the carriage 23, a liquid supply path 31, a storage portion 32, a storage portion holder 33 that holds the storage portion 32, and a flow path adapter 34 connected to the storage portion 32. The liquid ejecting portion 30 is held at the lower portion of the carriage 23. The storage portion 32 is held at the upper portion of the carriage 23. The liquid supply path 31 supplies the liquid supplied from the liquid supply source 27 to the liquid ejecting portion 30.

The storage portion 32 temporarily stores the liquid between the liquid supply path 31 and the liquid ejecting portion 30. The liquid ejecting apparatus 11 may include a plurality of the storage portions 32. The storage portion 32 is provided at least for each type of liquid. Examples of the liquid include an ink containing a coloring material, a storage liquid not containing a coloring material, and a treatment liquid for promoting fixing of an ink. When a plurality of the storage portions 32 respectively store color inks of different colors, color printing is possible.

Examples of the colors of the color inks include cyan, magenta, yellow, black, and white. Color printing may be performed with four colors of cyan, magenta, yellow, and black, or may be performed with three colors of cyan, magenta, and yellow. Color printing may be performed by adding at least one of light cyan, light magenta, light yellow, orange, green, gray, and the like to the three colors of cyan, magenta, and yellow. Each ink may contain a preservative.

The white ink can be used for background printing before color printing when printing on a medium ST that is a transparent or translucent film, or a dark medium ST. Background printing may also be referred to as solid printing or fill printing.

The storage portion 32 has a differential pressure valve 35. The differential pressure valve 35 is a so-called pressure reducing valve. That is, the differential pressure valve 35 opens when the liquid pressure between the differential pressure valve 35 and the liquid ejecting portion 30 falls below a predetermined negative pressure lower than the atmospheric pressure as a result of the liquid ejecting portion 30 consuming the liquid. At this time, the differential pressure valve 35 enables the flow of the liquid from the storage portion 32 toward the liquid ejecting portion 30.

The differential pressure valve 35 closes when the liquid pressure between the differential pressure valve 35 and the liquid ejecting portion 30 returns to a predetermined negative pressure as the liquid flows from the storage portion 32 toward the liquid ejecting portion 30. At this time, the differential pressure valve 35 stops the flow of the liquid from the storage portion 32 toward the liquid ejecting portion 30. The differential pressure valve 35 does not open even if the liquid pressure between the differential pressure valve 35 and the liquid ejecting portion 30 increases. Therefore, the differential pressure valve 35 functions as a one way valve (so-called check valve) that enables the flow of liquid from the storage portion 32 to the liquid ejecting portion 30 and suppresses the flow of liquid from the liquid ejecting portion 30 to the storage portion 32.

The liquid supply path 31 has second supply tubes 25*b*, the upstream end of which is connected to the connection portion 26. The downstream end of the second supply tubes 25*b* is connected to the flow path adapter 34 at a position above the storage portion 32. A liquid is supplied to the storage portion 32 through the first supply tubes 25*a*, the second supply tubes 25*b*, and the flow path adapter 34 in this order.

The drying unit 15 of the present embodiment includes a heat generating mechanism 36 and a blower mechanism 37. The heat generating mechanism 36 is located above the carriage 23. When the carriage 23 is reciprocating between the heat generating mechanism 36 and the support base 13, the liquid ejecting portion 30 ejects the liquid to the medium ST stopped on the support base 13.

The heat generating mechanism 36 has a heat generating member 38 and a reflection plate 39 extending in the X-axis direction. The heat generating member 38 is, for example, an infrared heater. The heat generating mechanism 36 emits radiant heat, which is heat such as infrared rays, from the heat generating member 38, and heats the medium ST in the area indicated by the dashed dotted arrows in FIG. 1. The blower mechanism 37 blows air to the area heated by the heat generating mechanism 36 to promote drying of the medium ST.

The carriage 23 may have a heat shield member 40 between the storage portion 32 and the heat generating mechanism 36 for blocking the heat transfer from the heat generating mechanism 36. The heat shield member 40 is formed of, for example, a heat conductive metal material such as stainless steel or aluminum. The heat shield member 40 preferably covers at least an upper surface of the storage portion 32.

The liquid ejecting apparatus 11 includes a control unit 41 that controls various operations performed by the liquid ejecting apparatus 11. The control unit 41 includes, for example, a processing circuit including a computer and a memory, and controls the transport motor 22 and the carriage motor 24 in accordance with a program stored in the memory.

Figure 2:
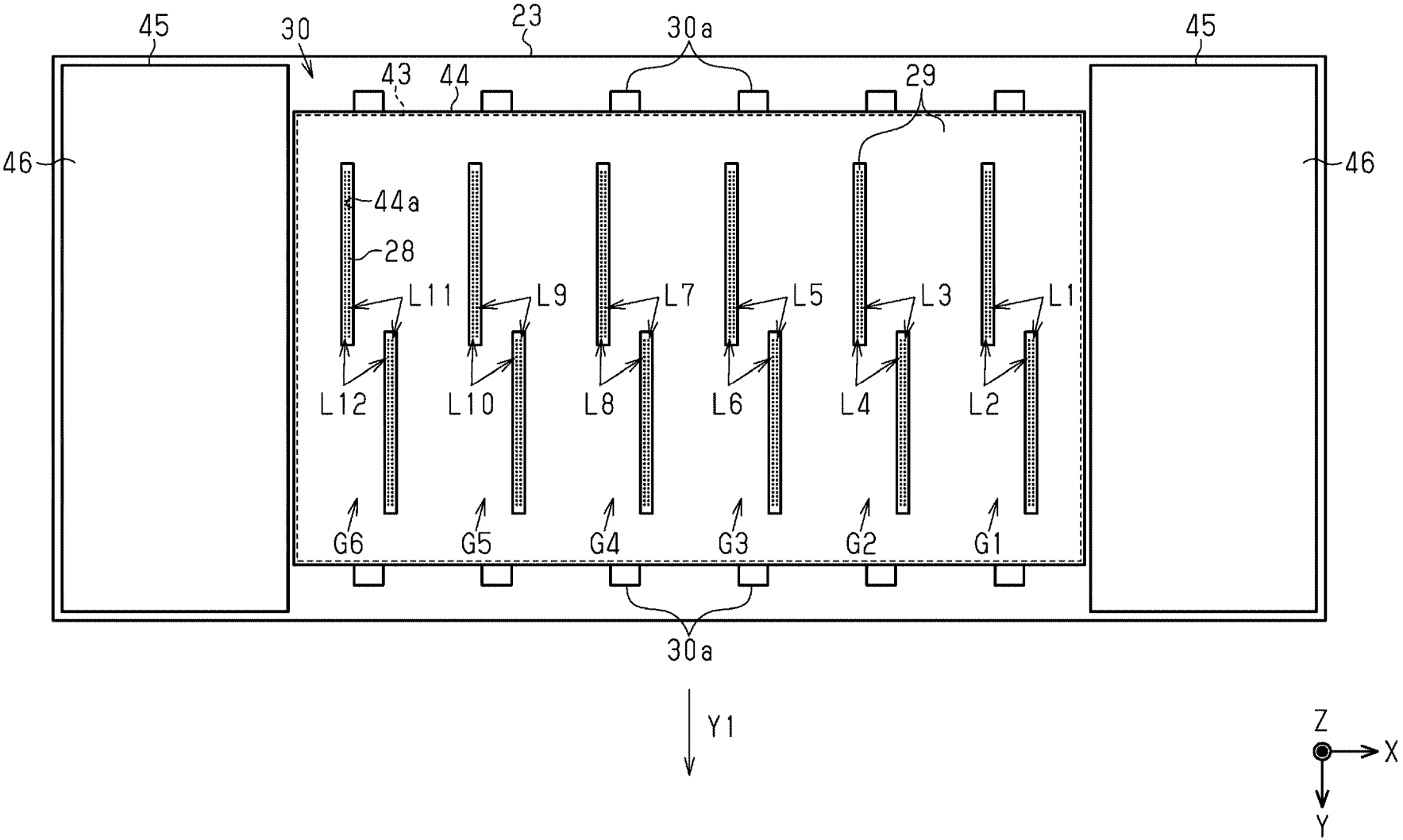
FIG. 2 is a schematic bottom view of a liquid ejecting portion.

As illustrated in FIG. 2, the liquid ejecting portion 30 may include a nozzle forming member 43 in which a plurality of the nozzles 28 are formed, and a cover member 44 that covers a portion of the nozzle forming member 43. The cover member 44 is formed of, for example, a metal such as stainless steel. The cover member 44 is formed with a plurality of through holes 44*a* that penetrate the cover member 44 in the Z-axis direction. The cover member 44 covers the side on which the nozzles 28 are formed in the nozzle forming member 43 so that the nozzles 28 are exposed from the through holes 44*a*. The nozzle surface 29 is formed to include the nozzle forming member 43 and the cover member 44. Specifically, the nozzle surface 29 includes the nozzle forming member 43, which is exposed from the through holes 44*a*, and the cover member 44.

In the liquid ejecting portion 30, a large number of openings of the nozzles 28 that eject the liquid are arranged in one direction at constant intervals to form nozzle arrays. In the present embodiment, the openings of the nozzles 28 are arranged in the transport direction Y1 to form a first nozzle array L1 to a twelfth nozzle array L12. The nozzles 28 forming one nozzle array eject the same type of liquid. Among the nozzles 28 forming one nozzle array, the nozzles 28 located upstream in the transport direction Y1 and the nozzles 28 located downstream in the transport direction Y1 are formed at positions shifted in the X-axis direction.

The first nozzle array L1 to the twelfth nozzle array L12 are arrayed close to each other in the X-axis direction in twos. In the present embodiment, two nozzle arrays arranged close to each other are referred to as a nozzle group. In the liquid ejecting portion 30, a first nozzle group G1 to a sixth nozzle group G6 are arranged at regular intervals in the X-axis direction.

Specifically, the first nozzle group G1 includes the first nozzle array L1 that ejects magenta ink and the second nozzle array L2 that ejects yellow ink. The second nozzle group G2 includes the third nozzle array L3 that ejects cyan ink and the fourth nozzle array L4 that ejects black ink. The third nozzle group G3 includes the fifth nozzle array L5 that ejects light cyan ink and the sixth nozzle array L6 that ejects light magenta ink. The fourth nozzle group G4 includes the seventh nozzle array L7 and the eighth nozzle array L8 that eject a treatment liquid. The fifth nozzle group G5 includes the ninth nozzle array L9 that ejects black ink and the tenth nozzle array L10 that ejects cyan ink. The sixth nozzle group G6 includes the eleventh nozzle array L11 that ejects yellow ink and the twelfth nozzle array L12 that ejects magenta ink.

The liquid ejecting portion 30 is formed with a plurality of projecting portions 30*a* that protrude on both sides in the transport direction Y1. Among the plurality of projecting portions 30*a*, every two projecting portions 30*a* located at the same position in the X-axis direction form a pair. The pairs of the projecting portions 30*a* are provided at the same intervals as the nozzle groups in the X-axis direction.

The liquid ejecting apparatus 11 may include airflow adjustment portions 45 held at a lower portion of the carriage 23. The airflow adjustment portions 45 may include facing portions 46 that face the medium ST supported by the support base 13 or the support base 13. In other words, the facing portions 46 are provided on the carriage 23 that moves with the liquid ejecting portion 30 mounted thereon. The facing portions 46 may be located at the same position as the nozzle surface 29, which includes the cover member 44, in the Z-axis direction. When the airflow adjustment portions 45 are provided on both sides of the liquid ejecting portion 30 in the X-axis direction, the airflow around the liquid ejecting portion 30 that reciprocates in the X-axis direction can be easily controlled. Both ends of the facing portions 46 in the transport direction Y1 are located outside the projecting portions 30*a*.

Figure 3:
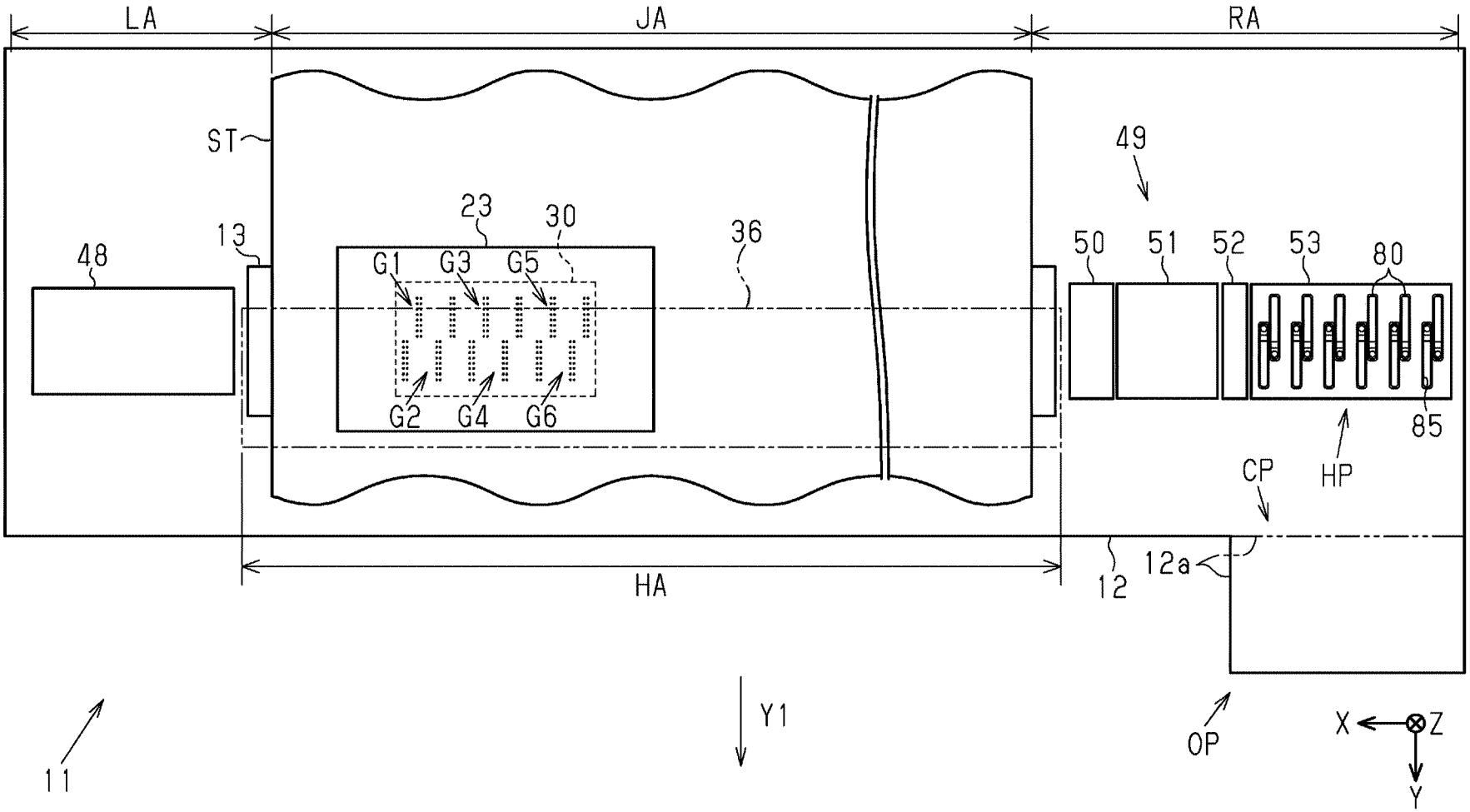
FIG. 3 is a plan view schematically illustrating the arrangement of components of the liquid ejecting apparatus.

As illustrated in FIG. 3, a movement area in which the liquid ejecting portion 30 can move in the X-axis direction includes an ejection area JA in which the liquid ejecting portion 30 ejects the liquid from the nozzles 28 to the medium ST to perform printing, and a non-printing area LA and a maintenance area RA that are outside the ejection area JA. The non-printing area LA and the maintenance area RA are located on both outer sides of the ejection area JA in the X-axis direction and are adjacent to the ejection area JA. The ejection area JA is an area where the liquid ejecting portion 30 can eject the liquid to the medium ST having the largest width. When the printing unit 16 has a borderless printing function, the ejection area JA is an area slightly larger in the X-axis direction than the medium ST having the largest width. A heating area HA in which the heat generating mechanism 36 heats the medium ST overlaps the ejection area JA.

The liquid ejecting apparatus 11 includes a moisturizing device 48 provided in the non-printing area LA, and a maintenance unit 49 provided in the maintenance area RA. The maintenance unit 49 includes a liquid collection device 50, a wiping device 51, a suction device 52, and a capping device 53 in order from a position close to the ejection area JA. The capping device 53 is provided at a position farther from the ejection area JA than the liquid collection device 50. Above the capping device 53 is a home position HP of the liquid ejecting portion 30. The home position HP is the starting point of the movement of the liquid ejecting portion 30.

The opening and closing member 12*a* is provided in the maintenance area RA. The opening and closing member 12*a* is provided in line with the capping device 53 in the X-axis direction. The opening and closing member 12*a*, when located at the closed position CP, covers the capping device 53. When the opening and closing member 12*a* is located at the open position OP, the capping device 53 can be viewed from outside the casing 12.

Next, the moisturizing device 48 will be described.

Figure 4:
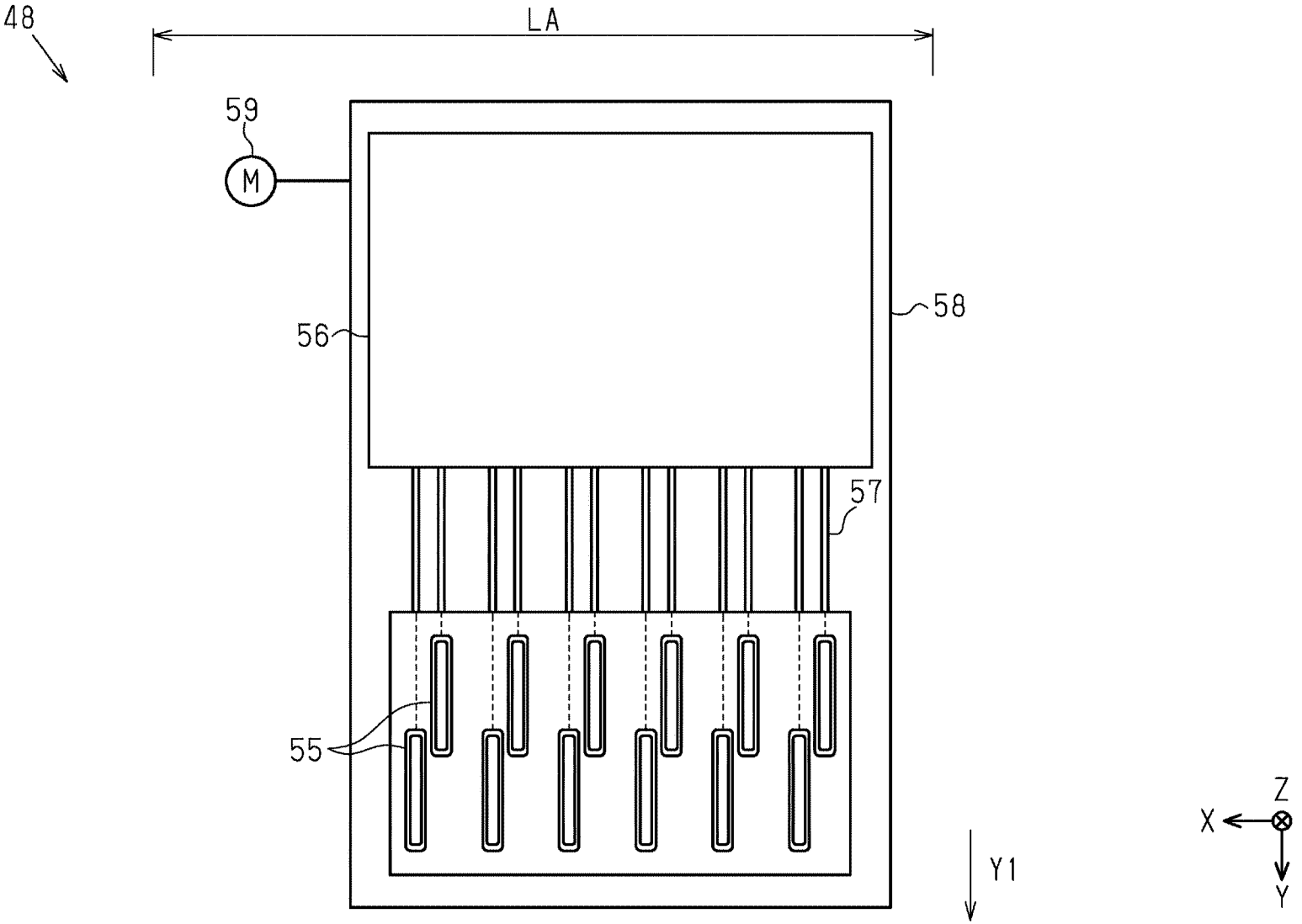
FIG. 4 is a schematic plan view of a moisturizing device.

As illustrated in FIG. 4, the moisturizing device 48 includes moisturizing caps 55, a moisturizing liquid supply unit 56, connection flow paths 57, a moisturizing holder 58, and a moisturizing motor 59 for moving the moisturizing holder 58 up and down. The connection flow paths 57 respectively connect the moisturizing caps 55 and the moisturizing liquid supply unit 56 to each other. The moisturizing liquid supply unit 56 supplies a moisturizing liquid into the moisturizing caps 55 via the connection flow paths 57. The moisturizing holder 58 holds the moisturizing caps 55 and the moisturizing liquid supply unit 56.

When the moisturizing holder 58 is moved up and down by the moisturizing motor 59, the moisturizing caps 55 and the moisturizing liquid supply unit 56 are moved up and down together. Thus, the moisturizing caps 55 move between a contact position where the moisturizing caps 55 are in contact with the liquid ejecting portion 30 and a retracted position where the moisturizing caps 55 are separated from the liquid ejecting portion 30.

The moisturizing caps 55 move to the contact position when the liquid ejecting portion 30 is stopped at the non-printing area LA, and contact the liquid ejecting portion 30 so as to surround the openings of the nozzles 28. Thus, maintenance in which the moisturizing caps 55 surround the openings of the nozzles 28 is referred to as moisturizing capping. Moisturizing capping is a type of capping. Moisturizing capping suppresses drying of the nozzles 28.

Next, the liquid collection device 50, the wiping device 51, the suction device 52, and the capping device 53 included in the maintenance unit 49 will be described.

Figure 5:
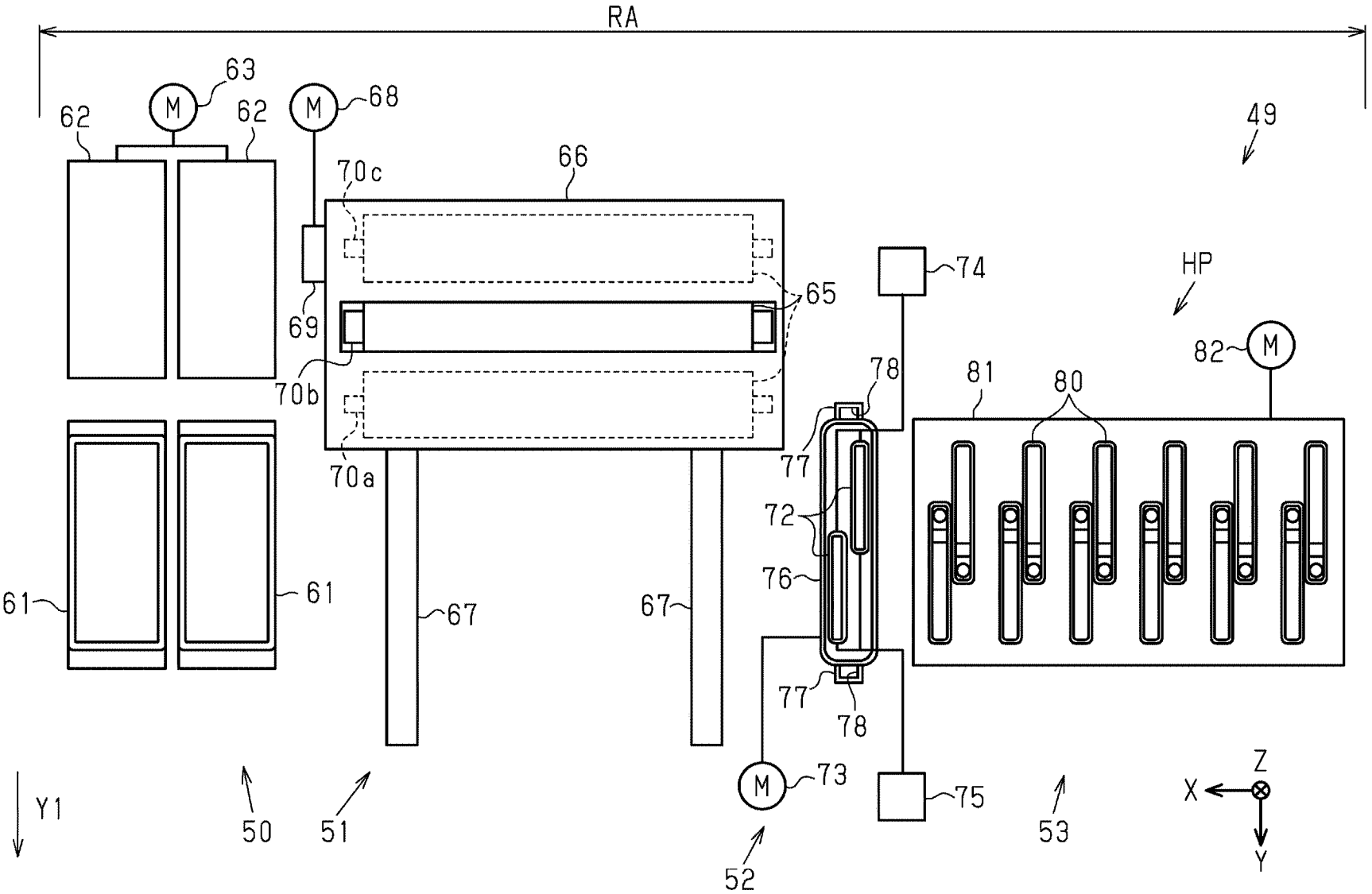
FIG. 5 is a schematic plan view of a maintenance unit.

As illustrated in FIG. 5, the liquid collection device 50 collects a liquid, which has been discharged from the nozzles 28 for the purpose of maintenance of the liquid ejecting portion 30. The liquid ejecting portion 30 ejects liquid as waste liquid for the purpose of preventing and eliminating clogging of the nozzles 28. This maintenance is called flushing.

The liquid collection device 50 includes liquid receiving portions 61 for receiving the liquid ejected by the liquid ejecting portion 30 for flushing, lid members 62 for respectively covering the openings of the liquid receiving portions 61, and a lid motor 63 that moves the lid members 62. The liquid collection device 50 may include a plurality of the liquid receiving portions 61 and a plurality of the lid members 62. The liquid ejecting portion 30 may select the liquid receiving portion 61 according to the type of liquid. In the present embodiment, the liquid receiving portion 61 on the side of the ejection area JA receives a plurality of color inks ejected as flushing from the liquid ejecting portion 30, and the liquid receiving portion 61 on the side of the wiping device 51 receives treatment liquid ejected as flushing from the liquid ejecting portion 30. In addition, the liquid receiving portions 61 may also contain a moisturizer.

The lid members 62 are moved by the lid motor 63 between a covering position where the openings of the liquid receiving portions 61 are covered and an exposed position where the openings of the liquid receiving portions 61 are exposed. When flushing is not performed, the lid members 62 move to the covering position, thereby suppressing drying of the contained moisturizing liquid and the received liquid.

The wiping device 51 includes sheet-like wiping members 65 that wipe the liquid ejecting portion 30, a case 66 for housing the wiping members 65, a pair of rails 67 extending in the transport direction Y1, and a wiping motor 68 that moves the case 66. The case 66 is provided with a power transmission mechanism 69 for transmitting the power of the wiping motor 68. The power transmission mechanism 69 is formed of, for example, a rack and pinion mechanism. The case 66 reciprocates on the rails 67 in the transport direction Y1 by the power of the wiping motor 68.

The case 66 supports a feeding shaft 70*a*, a pressing roller 70*b*, and a take-up shaft 70*c* so as to enable rotation of the feeding shaft 70*a*, the pressing roller 70*b*, and the take-up shaft 70*c*. The case 66 has an opening above the pressing roller 70*b*. The feeding shaft 70*a* feeds the wiping member 65, and the take-up shaft 70*c* winds the portion of the wiping member 65 that has been used. The pressing roller 70*b* pushes up the wiping member 65 between the feeding shaft 70*a* and the take-up shaft 70*c* and causes the wiping member 65 to protrude from the opening of the case 66.

The case 66, by the forward rotation of the wiping motor 68, moves downstream in the transport direction Y1 from an upstream position illustrated in FIG. 5 and reaches a downstream position. Thereafter, the case 66 is moved from the downstream position to the upstream position by reverse rotation of the wiping motor 68. The wiping member 65 may wipe the liquid ejecting portion 30 in at least one of the process of moving the case 66 from the upstream position to the downstream position and the process of moving the case 66 from the downstream position to the upstream position. The wiping is maintenance that involves wiping with the wiping member 65.

The power transmission mechanism 69 may separate the wiping motor 68 and the take-up shaft 70*c* when the wiping motor 68 rotates forward, and may connect the wiping motor 68 and the take-up shaft 70*c* when the wiping motor 68 rotates in reverse. The take-up shaft 70*c* may be rotated by the reversing power of the wiping motor 68. The take-up shaft 70*c* may wind the wiping member 65 when the case 66 moves from the downstream position to the upstream position.

The suction device 52 includes suction caps 72 and a suction motor 73 that reciprocates the suction caps 72 in the Z-axis direction. The suction device 52 includes a cleaning liquid supply mechanism 74 for supplying a cleaning liquid into the suction caps 72, and a discharge mechanism 75 for discharging a liquid in the suction caps 72.

When the liquid ejected by the liquid ejecting portion 30 is an aqueous ink, the cleaning liquid may be pure water, or may be water to which an additive such as a preservative, surfactant or moisturizer is added. When the liquid ejected by the liquid ejecting portion 30 is solvent ink, the cleaning liquid may be a solvent.

The suction caps 72 may be configured to surround all the nozzles 28 collectively, may be configured to surround at least one nozzle group, or may be configured to surround some of the nozzles 28 among the nozzles 28 that form a nozzle group. The suction device 52 according to the present embodiment includes, among the nozzles 28 forming one nozzle group, the suction cap 72 corresponding to the nozzles 28 located upstream in the transport direction Y1 and the suction cap 72 corresponding to the nozzles 28 located downstream in the transport direction Y1. The suction device 52 may include a tub 76 that houses that two suction caps 72. Projecting portions 77 may be provided on both sides of the tub 76 in the transport direction Y1. The projecting portions 77 may be provided with positioning portions 78, which are open at the top and recessed.

The suction motor 73 moves the suction caps 72 and the tub 76 between a contact position and a retracted position. The contact position is a position where the suction caps 72 are in contact with the liquid ejecting portion 30. The retracted position is a position where the suction caps 72 are separated from the liquid ejecting portion 30.

When the suction motor 73 moves the suction caps 72 and the tub 76 located at the retracted position to the contact position, the projecting portions 30*a* of the liquid ejecting portion 30 are inserted into the positioning portions 78 of the suction device 52. The suction caps 72 are positioned in the X-axis direction and the Y-axis direction by engagement of the projecting portions 30*a* and the positioning portions 78.

The capping device 53 includes resting caps 80, which are an example of a cap, a resting holder 81, and a resting motor 82 that moves the resting holder 81 up and down. When the resting holder 81 is moved up and down by the resting motor 82, the resting caps 80 are moved up and down. The resting caps 80 move from a separated position illustrated in FIG. 7 to a capping position illustrated in FIG. 8 and come into contact with the nozzle surface 29 of the liquid ejecting portion 30 stopped at the home position HP.

The resting caps 80 located at the capping position enclose the openings of the nozzles 28 forming the first to sixth nozzle groups G1 to G6. Thus, maintenance in which the resting caps 80 surround the openings of the nozzles 28 is called resting capping. Resting capping is a type of capping. The resting capping suppresses drying of the nozzles 28.

The resting caps 80 may be configured to surround all the nozzles 28 collectively, may be configured to surround at least one nozzle group, or may be configured to surround some of the nozzles 28 among the nozzles 28 that constitute a nozzle group. The capping device 53 of the present embodiment has twelve resting caps 80. Among the nozzles 28 constituting one nozzle group, one resting cap 80 corresponds to the nozzles 28 located upstream in the transport direction Y1 and one resting cap 80 corresponds to the nozzles 28 located downstream in the transport direction Y1. Although the resting cap 80 located upstream in the transport direction Y1 and the resting cap 80 located downstream in the transport direction Y1 have different orientations, their configurations are the same.

Figure 6:
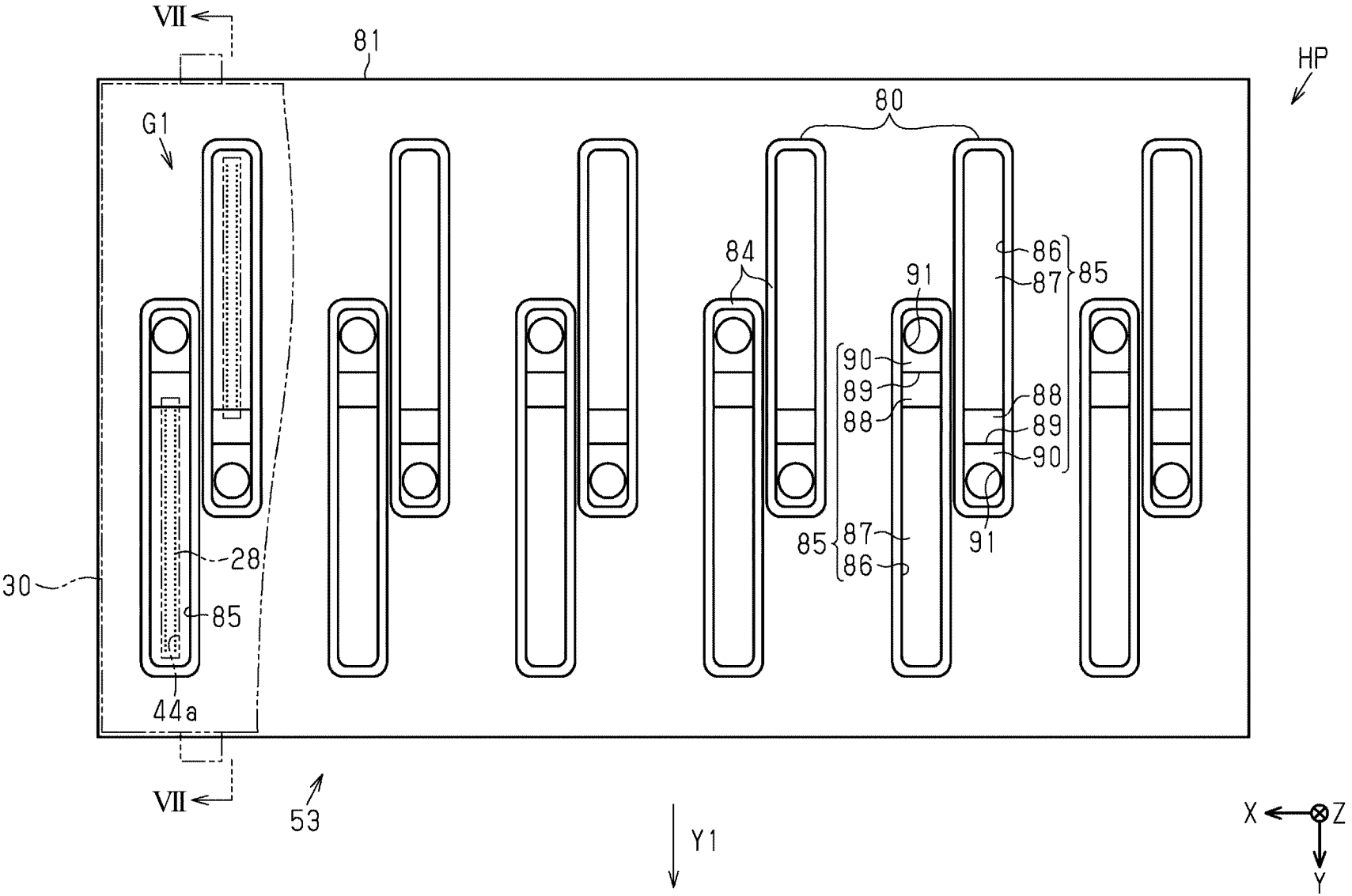
FIG. 6 is a schematic plan view of a capping device.

As illustrated in FIG. 6, the resting caps 80 each have a lip portion 84 that is annular and that can contact the nozzle surface 29 and a recessed portion 85 that is recessed on the inside of the lip portion 84 with the lip portion 84 as the upper end. The opening area of the recessed portion 85 is larger than the opening area of the through hole 44*a*. Therefore, when the resting cap 80 is located at the capping position, the lip portion 84 is in contact with the nozzle surface 29 including the cover member 44.

The recessed portion 85 may include an outer peripheral wall 86, an inclined side wall 87, an inner bottom wall 88, a side wall 89, and an atmosphere communication wall 90. At least one of the inner bottom wall 88, the atmosphere communication wall 90, the side wall 89, and the inclined side wall 87, which are walls forming the recessed portion 85, and at least a portion of the outer peripheral wall 86, and the lip portion 84 may be integrally formed of an elastic member. The outer peripheral wall 86, the inclined side wall 87, the inner bottom wall 88, the side wall 89, and the atmosphere communication wall 90 are provided so as to be visible from the opening side of the recessed portion 85 with the lip portion 84 as an edge.

The outer peripheral wall 86 is a wall connected to the lip portion 84 and forms an opening of the recessed portion 85. The outer peripheral wall 86 surrounds the outside of the inclined side wall 87, the inner bottom wall 88, the side wall 89, and the atmosphere communication wall 90. The outer peripheral wall 86 intersects the inclined side wall 87, the inner bottom wall 88, the side wall 89, and the atmosphere communication wall 90 at a position lower than the lip portion 84.

A communication port 91 is formed in the atmosphere communication wall 90 toward the opening of the recessed portion 85. That is, the communication port 91 is formed so as to be visible from the opening of the recessed portion 85 when the opening of the recessed portion 85 is not covered. The atmosphere communication wall 90 is provided at a position between the opening of the recessed portion 85 and the inner bottom wall 88 in the Z-axis direction that is a depth direction of the recessed portion 85.

In the case where a plurality of the resting caps 80 are provided, if the resting caps 80 are provided such that the communication port 91 is positioned near the center of the transport direction Y1, cleaning of the periphery of the communication port 91 is facilitated. In the present embodiment, of the two resting caps 80 covering one nozzle group, the resting cap 80 located upstream in the transport direction Y1 is disposed such that the atmosphere communication wall 90 is located downstream of the inner bottom wall 88 in the transport direction Y1. The resting cap 80 located downstream in the transport direction Y1 is disposed such that the atmosphere communication wall 90 is located upstream of the inner bottom wall 88 in the transport direction Y1. The resting cap 80 may be disposed so that the inclined side wall 87 is located at a position directly below the nozzles 28.

Figure 7:
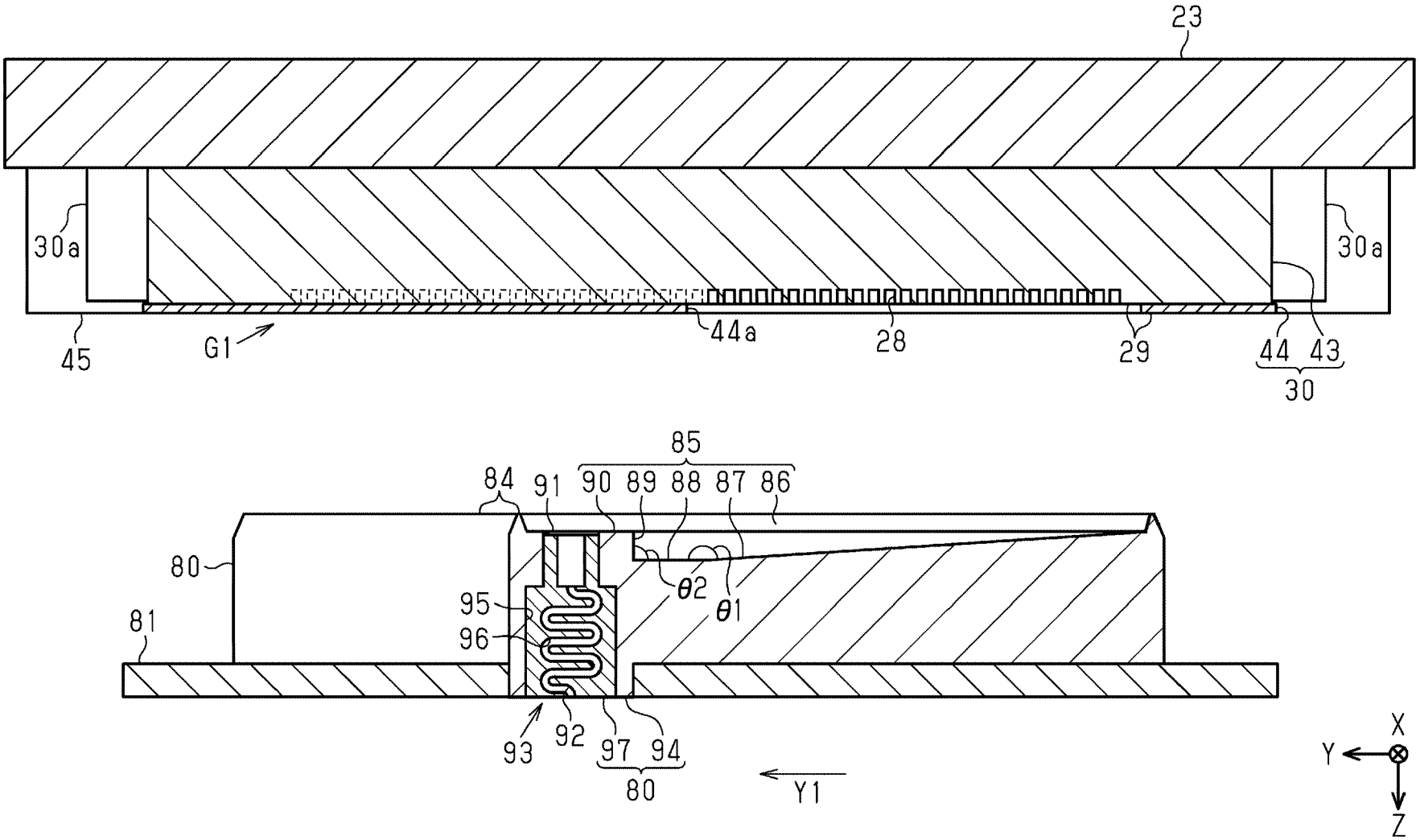
FIG. 7 is a schematic sectional view taken along the line VII-VII in FIG. 6.

As illustrated in FIG. 7, the inner bottom wall 88 is located between the side wall 89 and the inclined side wall 87 in the transport direction Y1. The atmosphere communication wall 90, the side wall 89, and the inclined side wall 87 are located between the inner bottom wall 88 and the lip portion 84 in the transport direction Y1.

The outer peripheral wall 86 connects the inner bottom wall 88, the atmosphere communication wall 90, the side wall 89, the inclined side wall 87, and the lip portion 84 in the Z-axis direction. The side wall 89 is located between the atmosphere communication wall 90 and the inner bottom wall 88 in the transport direction Y1, and connects the atmosphere communication wall 90 and the inner bottom wall 88 to each other. The lip portion 84, the atmosphere communication wall 90, and the inner bottom wall 88 may be provided continuously in a step-like manner. The inclined side wall 87 may connect the inner bottom wall 88 and the lip portion 84 without the atmosphere communication wall 90.

The inner bottom wall 88 is provided at a lower position away from the opening of the recessed portion 85 in the Z-axis direction than the atmosphere communication wall 90, the side wall 89 and the inclined side wall 87. The inclination of the inner bottom wall 88 with respect to the horizontal plane is smaller than the inclination of the inclined side wall 87 with respect to the horizontal plane. The inner bottom wall 88 of the present embodiment is formed along a horizontal plane. A first inner angle θ1 formed by the inclined side wall 87 and the inner bottom wall 88 is larger than a second inner angle θ2 formed by the side wall 89 and the inner bottom wall 88.

The resting cap 80 includes an atmosphere communication portion 93 that enables communication between the communication port 91 formed inside the recessed portion 85 with an opening 92 formed outside the recessed portion 85. The atmosphere communication portion 93 may be formed by fitting a rigid member 97 having a groove 96 formed on the side surface in a cap member 94 and an insertion hole 95 formed in the cap member 94. The atmosphere communication portion 93 may be formed by closing the groove 96 with the inner surface of the insertion hole 95. The width of the groove 96 may be smaller than the diameter of the communication port 91. The groove 96 may be formed so as to meander. The atmosphere communication portion 93 is provided at a position farther from the opening of the recessed portion 85 than is the communication port 91.

Figure 8:
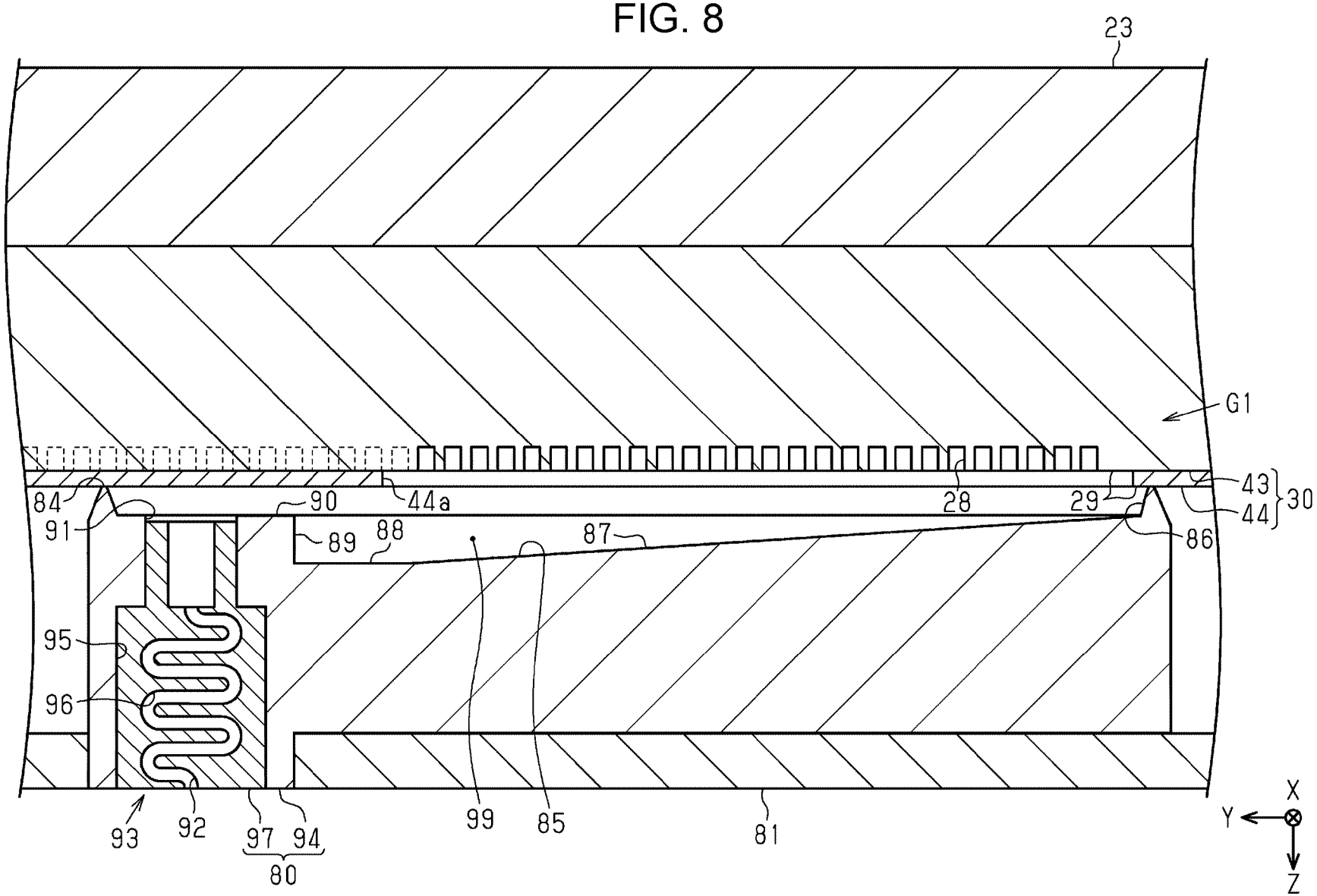
FIG. 8 is a schematic sectional view of the resting cap located at the capping position.

As illustrated in FIG. 8, in the resting cap 80 located at the capping position, the lip portion 84 is in contact with the nozzle surface 29 and the opening of the recessed portion 85 is covered by the nozzle surface 29 of the liquid ejecting portion 30, which is an example of a member. In the capping state, the communication port 91 formed toward the opening of the recessed portion 85 faces the nozzle surface 29. The recessed portion 85 forms a space 99 including the nozzles 28 between the recessed portion 85 and the liquid ejecting portion 30 when the resting cap 80 is at the capping position. The atmosphere communication portion 93 opens the space 99 to the atmosphere.

While the resting cap 80 is located at the capping position, the lip portion 84 is in contact with the nozzle surface 29 and the space 99 is formed. The atmosphere communication wall 90 may face the cover member 44 when the space 99 is formed. In the state where the lip portion 84 is in contact with the nozzle surface 29, the communication port 91 may be formed at a position different from a position directly below the nozzles 28. The atmosphere communication wall 90, the side wall 89, and the inner bottom wall 88 may be located at positions different from positions directly below the nozzles 28.

Next, liquid repellency will be described.

The liquid repellencies of the nozzle surface 29, the suction caps 72, and the resting caps 80 may be different from one another. The liquid repellency of the nozzle surface 29 may differ between the portion formed by the nozzle forming member 43 and the portion formed by the cover member 44. For example, the nozzle surface 29 including the nozzle forming member 43 may have a higher liquid repellency than the nozzle surface 29 including the cover member 44. In the present embodiment, the nozzle surface 29 including the nozzle forming member 43, the suction cap 72, the resting cap 80, and the nozzle surface 29 including the cover member 44 are in order from the one with a high liquid repellency and a low wettability.

Liquid repellent treatment may be applied to the nozzle surface 29 including the nozzle forming member 43. The contact angle formed by the nozzle surface 29 including the nozzle forming member 43 and an ink droplet, which is an example of a liquid, may be 90 degrees or more. In the liquid repellent treatment, a liquid repellent film layer composed of a thin-film underlayer mainly composed of an alkyl group-containing polyorganosiloxane and a metal alkoxide having a long chain polymer group containing fluorine may be formed.

The cover member 44 may be formed of stainless steel and need not be subjected to the liquid repellent treatment. The contact angle formed by the nozzle surface 29 including the cover member 44 and an ink droplet may be less than 50 degrees.

The suction caps 72 may be formed of a liquid repellent fluorine-based elastomer. Examples of fluorine-based elastomers include Shin-Etsu Chemical Shin-Etsusifel (registered trademark), DuPont Carlets (registered trademark), and the like. The suction caps 72 may each have a lip portion and a recessed portion that are composed of a fluorine-based elastomer so as to have liquid repellency, the lip portion being in contact with the nozzle surface 29 when located at the contact position, and the recessed portion forming a space with the nozzle surface 29. The contact angle formed by the surface formed of the fluoroelastomer and an ink droplet is about 60 degrees. The surfaces of the lip portion and the recessed portion of the suction cap 72 may have a mirror finish to suppress a decrease in liquid repellency due to unevenness of surfaces. The mirror finish may be, for example, a surface roughness Ra of 2.0 or less: a calculated average roughness of JIS standard JIS B0601.

The resting cap 80 may be formed of a styrene-based elastomer having a lower liquid repellency and a higher wettability than a fluorine-based elastomer. The styrene-based elastomer includes, for example, Riken Technos Leostomer (registered trademark). In the resting cap 80, the lip portion 84 and the recessed portion 85 may be formed of a styrenic elastomer. The contact angle formed between the surface formed of the styrenic elastomer and an ink droplet is less than 60 degrees.

There may be cases where a liquid splashed along with the ejection from the nozzles 28 or a liquid leaked from the nozzles 28 enters the resting cap 80. Examples of a liquid include one containing glycerin such as ink. When the resting cap 80 is in contact with the nozzle surface 29 to form the space 99 with ink contained therein, glycerin absorbs water from the ink in the nozzles 28 and thickens the ink in the nozzles 28. Therefore, the resting cap 80 may discharge a liquid adhering to the recessed portion 85 to the outside by using the wettability of the recessed portion 85.

Specifically, the resting cap 80 may discharge a liquid by using a liquid rising phenomenon. A liquid adhering to a surface having a high wettability wets and spreads along the surface, and also moves upward in the vertical direction. The resting cap 80 has a higher wettability than the suction cap 72. The nozzle surface 29 in contact with the lip portion 84 has a higher wettability than the resting cap 80. A liquid adhering to the inside of the resting cap 80 spreads and moves to the nozzle surface 29 in contact with the lip portion 84. Thereby, a liquid can be discharged from the inside of the resting cap 80. After the capping by the resting cap 80 is released, the wiping device 51 may wipe the nozzle surface 29 and wipe off liquid that has moved to the nozzle surface 29.

The resting cap 80 may have a different liquid repellency for each wall constituting the recessed portion 85. The liquid repellency may be varied by changing the surface roughness. For example, the contact angle formed by the surface of the inclined side wall 87 and a droplet of liquid may be smaller than the contact angle formed by the surface of the side wall 89 and a droplet of liquid. If the wettability of the surface of the inclined side wall 87 is higher than the wettability of the surface of the side wall 89, a liquid adhering to the inner bottom wall 88 is more likely guided to the inclined side wall 87 side. When the wettability of the outer peripheral wall 86 is made higher than the wettability of the inclined side wall 87, a liquid adhering to the inclined side wall 87 is more likely guided to the outer peripheral wall 86 side.

The operation of this embodiment will be described.

As illustrated in FIG. 3, when the opening and closing member 12*a* is located at the open position OP and the liquid ejecting portion 30 is positioned at a position different from the home position HP, the openings of the recessed portions 85 of the resting caps 80 can be accessed from outside the casing 12.

As illustrated in FIG. 6, the atmosphere communication walls 90 are accessible from the openings of the recessed portions 85. Therefore, the opening and closing member 12*a*, when located at the open position OP, enables the user to access the atmosphere communication walls 90. That is, the user can easily clean the atmosphere communication walls 90 in which the communication ports 91 are formed. The user may clean the inclined side walls 87 to which a liquid is likely to be attached opposite the nozzles 28. The user may clean the outer peripheral walls 86, the inner bottom walls 88, the side walls 89, and the lip portions 84 that form the recessed portions 85.

The effects of this embodiment will be described.

(1) The atmosphere communication wall 90 in which the communication port 91 is formed is provided at a position closer to the opening side than is the inner bottom wall 88. Therefore, compared with a case where the communication port 91 is formed in the inner bottom wall 88 or at a position farther from the opening than is the inner bottom wall 88, the area around the communication port 91 can be cleaned more easily. The atmosphere communication wall 90 is visible from the opening side, and the communication port 91 is formed toward the opening side. Therefore, the user can easily clean the area around the communication port 91 while performing a position check for the communication port 91 from the opening.

(2) For example, if there is a recessed portion between the lip portion 84 and the atmosphere communication wall 90 or between the atmosphere communication wall 90 and the inner bottom wall 88, cleaning is difficult. In that respect, since the lip portion 84, the atmosphere communication wall 90, and the inner bottom wall 88 continue in a step-like manner, the periphery of the atmosphere communication wall 90 can also be cleaned easily.

(3) The inner angle formed by the inclined side wall 87 and the inner bottom wall 88 is larger than the inner angle formed by the side wall 89 and the inner bottom wall 88. Therefore, when the liquid adheres to the inner bottom wall 88, the liquid is more likely to crawl up the inclined side wall 87 rather than the side wall 89. Therefore, the likelihood of the liquid rising to the atmosphere communication wall 90 through the side wall 89 can be reduced.

(4) For example, if the walls forming the recessed portion 85 and the lip portion 84 are separately formed, the liquid may adhere to the joint of the members, which may make cleaning difficult. In that respect, since the walls forming the recessed portion 85 and the lip portion 84 are integrally formed, the lip portion 84 and the recessed portion 85 can be easily cleaned. The member forming the recessed portion 85 and the lip portion 84 is an elastic member. Therefore, the adhesion between the recessed portion 85 and the nozzle surface 29 covering the opening of the recessed portion 85 can be enhanced.

(5) The atmosphere communication wall 90 in which the communication port 91 is formed can be accessed when the opening and closing member 12*a* is located at the open position OP. The atmosphere communication wall 90 is provided at a position closer to the opening than is the inner bottom wall 88 forming the recessed portion 85. Therefore, the atmosphere communication wall 90 can be more easily accessed as compared with the case where the atmosphere communication wall 90 is provided at the same position as the inner bottom wall 88 or at a position farther from the opening than the inner bottom wall 88. The user can easily clean the periphery of the communication port 91 formed in the atmosphere communication wall 90.

(6) The communication port 91 is formed at a position different from a position directly below the nozzles 28. Therefore, even when a liquid drips from the nozzles 28, the likelihood of the liquid entering the atmosphere communication portion 93 from the communication port 91 can be reduced.

(7) When the liquid ejecting portion 30 ejects a liquid from the nozzles 28, a fine liquid may fly in the form of a mist and adhere to the surroundings. When the nozzle forming member 43 is covered with the cover member 44, a liquid is more likely to adhere to the nozzle forming member 43 than the cover member 44. In that respect, when the lip portion 84 comes into contact with the cover member 44 to form the space 99, the atmosphere communication wall 90 faces the cover member 44. Therefore, even when a liquid drips from the nozzle forming member 43, the likelihood of the liquid entering the atmosphere communication portion 93 from the communication port 91 can be reduced.

(8) The capping device 53 having the resting caps 80 is provided at a position further from the ejection area JA than is the liquid collection device 50. Therefore, compared with the case where the capping device 53 is provided at a position close to the ejection area JA, the likelihood of a liquid adhering to the resting caps 80 can be reduced.

The present embodiment can be implemented with the following modifications. The present embodiment and the following modifications can be implemented in combination with each other to the extent that they do not conflict technically.

The liquid ejecting apparatus 11 need not be provided with the liquid collection device 50. The liquid ejecting portion 30 may collect a liquid, which has been discharged from the nozzles 28 for the purpose of maintenance, using the suction cap 72 or the wiping member 65.

The capping device 53 may be provided in the non-printing area LA. The capping device 53 may be provided closer to the ejection area JA than the liquid collection device 50.

The opening area of the through hole 44*a* may be larger than the opening area of the recessed portion 85. The through hole 44*a* and the lip portion 84 may be shaped so that the lip portion 84 can be housed inside the through hole 44*a*. The space 99 may be formed by the lip portion 84 coming into contact with the nozzle forming member 43. The liquid ejecting portion 30 need not include the cover member 44. The nozzle surface 29 may be a surface of the nozzle forming member 43.

The atmosphere communication wall 90 may face the nozzle forming member 43 in a state where the resting cap 80 is at the capping position. The atmosphere communication wall 90 may face both the nozzle forming member 43 and the cover member 44 in a state where the resting cap 80 is at the capping position. The communication port 91 may be formed at a position directly below the nozzles 28 when the resting cap 80 is at the capping position.

At least one of the outer peripheral wall 86, the inclined side wall 87, the inner bottom wall 88, the side wall 89, and the atmosphere communication wall 90, which form the recessed portion 85, and the lip portion 84 may be made of separate members. At least one of the outer peripheral wall 86, the inclined side wall 87, the inner bottom wall 88, the side wall 89, and the atmosphere communication wall 90, and the lip portion 84 may be formed of a member different from the elastic member. For example, the lip portion 84 may be formed of an elastic member, and the outer peripheral wall 86 may be formed of a rigid member. The lip portion 84, the outer peripheral wall 86, the inclined side wall 87, the inner bottom wall 88, and the side wall 89 may be formed of an elastic member, and the atmosphere communication wall 90 may be formed of a rigid member.

The resting cap 80 may have the same inclination as the inner bottom wall 88 and the inclined side wall 87 with respect to the horizontal plane. That is, the first inner angle θ1 may be 180 degrees. In the resting cap 80 in the capping state, the surface facing the nozzles 28 may be a horizontal surface. The second inner angle θ2 may be less than 90 degrees. The inner bottom wall 88 may be provided at an angle to a horizontal plane.

The second internal angle θ2 may be 90 degrees or more. The inner bottom wall 88 may be inclined downward from the side wall 89 toward the inclined side wall 87.

The resting cap 80 may be formed without the side wall 89, and the atmosphere communication wall 90 may be inclined downward from the outer peripheral wall 86 toward the inner bottom wall 88. The atmosphere communication wall 90 may be a downward inclined surface from the side wall 89 toward the outer peripheral wall 86. The communication port 91 may be formed in the atmosphere communication wall 90, which is not parallel to a plane including the lip portion 84, toward the opening side of the recessed portion 85.

The lip portion 84 and the atmosphere communication wall 90, or the atmosphere communication wall 90 and the inner bottom wall 88 may be discontinuous. For example, cavities and protrusions may be provided between the lip portion 84 and the atmosphere communication wall 90 or between the atmosphere communication wall 90 and the inner bottom wall 88.

The opening and closing member 12*a* may be extended to a position covering the vertical upper side of the capping device 53 at the closed position CP. Then, when the opening and closing member 12*a* is located at the open position OP, the capping device 53 may be visible from vertically above the casing 12.

The opening and closing member 12*a* may be provided in line with the maintenance unit 49 in the X-axis direction so that the liquid collection device 50, the wiping device 51, the suction device 52, and the capping device 53 can be accessed.

The liquid ejecting apparatus 11 may be a liquid ejecting apparatus that ejects or discharges a liquid other than ink. The liquid discharged as a minute amount of liquid droplets from the liquid ejecting apparatus may have any of a grain shape, a teardrop shape, and a thread-like tail shape. The liquid referred to here may be any material as long as it can be ejected from the liquid ejecting apparatus. For example, the material may have any state as long as the substance is in a liquid phase, and it may be a liquid material having high or low viscosity, a sol, gel water, another inorganic solvent, an organic solvent, a solution, a liquid resin, a liquid metal, or a metal melt. Not only a liquid as one state of a substance, but also substances in which particles of a functional material composed of a solid material such as pigments and metal particles are dissolved, dispersed or mixed in a solvent, and the like are included. Representative examples of the liquid include ink, liquid crystals, and the like as described in the above embodiment. Here, examples of "ink" include various types of liquid compositions such as general water-based ink and oil-based ink, gel ink, hot melt ink and the like. A specific example of the liquid ejecting apparatus is a liquid ejecting apparatus that ejects a liquid containing dispersed or dissolved materials such as electrode materials and coloring materials used for manufacturing liquid crystal displays, electroluminescence displays, surface emitting displays, color filters, and the like. The liquid ejecting apparatus may be a liquid ejecting apparatus that ejects a bioorganic material used for biochip production, a liquid ejecting apparatus that is used as a precision pipette and ejects a liquid as a sample, a textile printing apparatus, a microdispenser, or the like. The liquid ejecting apparatus may be a liquid ejecting apparatus that ejects lubricating oil with pinpoint accuracy to a precision machine such as a watch or a camera, or a liquid ejecting apparatus that ejects a transparent resin liquid such as an ultraviolet curable resin liquid onto a substrate to form a micro hemispherical lens, an optical lens, or the like used for an optical communication element or the like. The liquid ejecting apparatus may be a liquid ejecting apparatus that ejects an etching solution such as an acid or an alkali to etch a substrate or the like.

The technical ideas grasped from the embodiment and the modifications described above and the operation effects thereof are described below.

A cap includes a lip portion, and an inner bottom wall and an atmosphere communication wall that, when an opening with the lip portion as an edge is covered by a member, form a recessed portion that forms a space with the member, the atmosphere communication wall being provided at a position closer to the opening than is the inner bottom wall so as to be visible from the opening, the atmosphere communication wall having a communication port of an atmosphere communication portion that opens the space to the atmosphere, the communication port being formed in the atmosphere communication wall toward the opening.

According to this configuration, the atmosphere communication wall in which the communication port is formed is provided at a position closer to the opening side than is the inner bottom wall. Therefore, compared with a case where the communication port is formed in the inner bottom wall or at a position farther from the opening than is the inner bottom wall, the area around the communication port can be cleaned more easily. The atmosphere communication wall is visible from the opening, and the communication port is formed toward the opening. Therefore, the user can easily clean the area around the communication port while performing a position check of the communication port from the opening.

In the cap, the lip portion, the atmosphere communication wall, and the inner bottom wall may be continuously provided in a step-like manner.

For example, if there is a recessed portion between the lip portion and the atmosphere communication wall or between the atmosphere communication wall and the inner bottom wall, cleaning is difficult. In that respect, according to this configuration, since the lip portion, the atmosphere communication wall, and the inner bottom wall are continuous in a step-like manner, the periphery of the atmosphere communication wall can be easily cleaned.

The cap includes a side wall connecting the atmosphere communication wall and the inner bottom wall, and an inclined side wall connecting the inner bottom wall and the lip portion without the atmosphere communication wall, and the inner angle formed by the inclined side wall and the inner bottom wall may be larger than the inner angle formed by the side wall and the inner bottom wall.

According to this configuration, the inner angle formed by the inclined side wall and the inner bottom wall is larger than the inner angle formed by the side wall and the inner bottom wall. Therefore, when a liquid adheres to the inner bottom wall, the liquid is more likely to crawl up the inclined side wall than the side wall. Therefore, it is possible to reduce the likelihood of the liquid rising to the atmosphere communication wall via the side wall.

In the cap, the walls forming the recessed portion and the lip portion may be integrally formed of an elastic member.

For example, if the walls forming the recessed portion and the lip portion are separately formed, the liquid may adhere to the joint of the members, which may make cleaning difficult. In that respect, according to this configuration, since the walls forming the recessed portion and the lip portion are integrally formed, the lip portion and the recessed portion can be easily cleaned. The member forming the recessed portion and the lip portion is an elastic member.

Therefore, the adhesiveness of the recessed portion and the member that covers the opening of the recessed portion can be improved.

A liquid ejecting apparatus includes a liquid ejecting portion having a nozzle surface provided with a nozzle from which a liquid is ejected, a capping device having a cap, and an opening and closing member configured to take a closed position and an open position, the cap having a lip portion that is configured to come in contact with the nozzle surface, and an inner bottom wall and an atmosphere communication wall that form a recessed portion that forms a space including the nozzle when the nozzle surface covers an opening with the lip portion as an edge in a case where the lip portion is in contact with the nozzle surface, the atmosphere communication wall being provided at a position closer to the opening than is the inner bottom wall, the atmosphere communication wall having a communication port of an atmosphere communication portion that opens the space to the atmosphere, the communication port being formed in the atmosphere communication wall, and the opening and closing member, when located at the closed position, covering the capping device, and, when located at the open position, enabling access to the atmosphere communication wall.

According to this configuration, the atmosphere communication wall in which the communication port is formed can be accessed when the opening and closing member is located at the open position. The atmosphere communication wall is provided at a position closer to the opening than is the inner bottom wall forming the recessed portion. Therefore, the atmosphere communication wall can be accessed more easily than when the atmosphere communication wall is provided at the same position as the inner bottom wall or at a position farther from the opening than is the inner bottom wall. The user can easily clean the area around the communication port formed in the atmosphere communication wall.

In the liquid ejecting apparatus, the communication port may be formed at a position different from a position directly below the nozzle when the lip portion is in contact with the nozzle surface.

According to this configuration, the communication port is formed at a position different from a position directly below the nozzle. Therefore, even when a liquid drips from the nozzle, the likelihood of the liquid entering the atmosphere communication portion from the communication port can be reduced.

In the liquid ejecting apparatus, the nozzle surface may be formed to include a nozzle forming member in which the nozzle is formed, and a cover member having a through hole so as to expose the nozzle and covering the side on which the nozzle is formed in the nozzle forming member, and a space may be formed such that the lip portion is in contact with the cover member, and the atmosphere communication wall may face the cover member when the space is formed.

When the liquid ejecting portion ejects the liquid from the nozzle, a fine liquid may fly in the form of a mist and adhere to the surroundings. When the nozzle forming member is covered with the cover member, the liquid is more likely to adhere to the nozzle forming member than the cover member. In that respect, according to this configuration, when the lip portion is in contact with the cover member to form a space, the atmosphere communication wall faces the cover member. Therefore, even when a liquid drips from the nozzle forming member, the likelihood of the liquid entering the atmosphere communication portion from the communication port can be reduced.

The liquid ejecting apparatus may further include a liquid collection device that collects the liquid, which has been discharged from the nozzle for the purpose of maintenance of the liquid ejecting portion, a maintenance area in which the capping device and the liquid collection device are provided may be adjacent to an ejection area in which the liquid ejecting portion ejects the liquid from the nozzle to the medium, and the capping device may be provided at a position farther from the ejection area than is the liquid collection device.

According to this configuration, the capping device having the cap is provided at a position farther from the ejection area than is the liquid collection device. Therefore, the likelihood of the liquid adhering to the cap can be reduced as compared with the case where the capping device is provided at a position close to the ejection area.

What is claimed is:

1. A cap comprising:

a lip portion; and an inner bottom wall and an atmosphere communication wall that, when an opening with the lip portion as an edge is covered by a member, form a recessed portion that forms a space with the member, wherein the atmosphere communication wall is provided at a position between the opening and the inner bottom wall in a depth direction of the recessed portion so as to be visible from the opening, and the atmosphere communication wall has a communication port of an atmosphere communication portion that opens the space to the atmosphere, the communication port being formed in the atmosphere communication wall toward the opening.

2. The cap according to claim 1, wherein the lip portion, the atmosphere communication wall, and the inner bottom wall are continuously provided in a step-like manner.

3. The cap according to claim 1, further comprising:

a side wall connecting the atmosphere communication wall and the inner bottom wall; and an inclined side wall that connects the inner bottom wall and the lip portion to each other without the atmosphere communication wall, wherein an inner angle formed by the inclined side wall and the inner bottom wall is larger than an inner angle formed by the side wall and the inner bottom wall.

4. The cap according to claim 1, wherein the walls forming the recessed portion and the lip portion are integrally formed of an elastic member.

5. A liquid ejecting apparatus comprising:

a liquid ejecting portion having a nozzle surface provided with a nozzle from which a liquid is ejected;

a capping device having a cap; and an opening and closing member configured to assume a closed position and an open position, wherein the cap includes a lip portion configured to come in contact with the nozzle surface, and an inner bottom wall and an atmosphere communication wall that form a recessed portion that forms a space including the nozzle when the nozzle surface covers an opening with the lip portion as an edge in a case where the lip portion is in contact with nozzle surface, wherein the atmosphere communication wall is provided at a position between the opening and the inner bottom wall in a depth direction of the recessed portion, the atmosphere communication wall has a communication port of an atmosphere communication portion that opens the space to the atmosphere, and the opening and closing member, when located at the closed position, covers the capping device, and, when located at the open position, enables access to the atmosphere communication wall.

6. The liquid ejecting apparatus according to claim 5, wherein the communication port is formed at a position different from a position directly below the nozzle in a state where the lip portion is in contact with the nozzle surface.

7. The liquid ejecting apparatus according to claim 5, wherein the nozzle surface is formed to include a nozzle forming member in which the nozzle is formed, and a cover member having a through hole so as to expose the nozzle and covering the side on which the nozzle is formed in the nozzle forming member, wherein the space is formed by the lip portion contacting the cover member, and the atmosphere communication wall faces the cover member in a state where the space is formed.

8. The liquid ejecting apparatus according to claim 5, further comprising:

a liquid collection device that collects the liquid discharged from the nozzle for the purpose of maintenance of the liquid ejecting portion, wherein a maintenance area in which the capping device and the liquid collection device are provided is adjacent to an ejection area in which the liquid ejecting portion ejects the liquid from the nozzle to the medium, and the capping device is provided at a position farther from the ejection area than is the liquid collection device.

* * * * *